US008132601B2

(12) United States Patent
Wang

(10) Patent No.: US 8,132,601 B2
(45) Date of Patent: Mar. 13, 2012

(54) TOTE BAG FOR BEING PARTITIONED OR ALTERNATIVELY EXPANDED

(75) Inventor: San Chyi Wang, New York, NY (US)

(73) Assignee: Tumi, Inc., South Plainfield, NJ (US)

( * ) Notice: Subject to any disclaimer, the term of this patent is extended or adjusted under 35 U.S.C. 154(b) by 921 days.

(21) Appl. No.: 11/888,199

(22) Filed: Jul. 30, 2007

(65) Prior Publication Data

US 2009/0032348 A1 Feb. 5, 2009

(51) Int. Cl.
*A45C 1/02* (2006.01)

(52) U.S. Cl. ..... 150/113; 150/112; 150/127; 383/2; 383/38; 383/121; 383/123; 383/125; 190/113

(58) Field of Classification Search ..... 383/2, 38, 383/121, 123, 125; 190/113; 150/112, 113, 150/127

See application file for complete search history.

(56) References Cited

U.S. PATENT DOCUMENTS

| | | | | |
|---|---|---|---|---|
| 589,208 | A * | 8/1897 | Gareis | 229/117.05 |
| 909,248 | A * | 1/1909 | Staeger | 383/2 |
| 2,078,624 | A * | 4/1937 | Wolff | 383/2 |
| 6,071,010 | A * | 6/2000 | Chan | 383/2 |
| 7,621,305 | B2 * | 11/2009 | Cho | 150/113 |
| 2006/0021685 | A1 * | 2/2006 | Cho | 150/113 |

* cited by examiner

*Primary Examiner* — Tri Mai
(74) *Attorney, Agent, or Firm* — Jon Fallon, Esq.

(57) ABSTRACT

A tote bag for being partitioned or alternatively expanded. The bag has a partition mode and an expansion mode and includes a front panel, a rear panel, and a pair of side panels. The front panel is attached to the rear panel by the pair of side panels. The pair of side panels fold and attach to each other to form a partition thereby dividing the tote bag into a pair of compartments when the tote bag is in the partition mode thereof and separate from each other and unfold to eliminate the partition thereby expanding the tote bag when the tote bag is in the expansion mode thereof.

5 Claims, 4 Drawing Sheets

TOTE BAG FOR BEING PARTITIONED OR ALTERNATIVELY EXPANDED

BACKGROUND OF THE INVENTION

A. Field of the Invention

The embodiments of the present invention relate to a tote bag, and more particularly, the embodiments of the present invention relate to a tote bag for being partitioned or alternatively expanded.

B. Description of the Prior Art

Carrier pouches for lunches, soft drinks, and the like are often made from flexible plastic or fabric material, with insulation provided in the side walls of the pouch. These containers, carriers, or pouches are often made in the shape of a lunch box, for example, or a purse or similar container and may have a limited capacity, i.e. these pouches are typically not expandable.

Numerous innovations for bags have been provided in the prior art that will be described below, which are in chronological order to show advancement in the art, and which are incorporated herein by reference thereto. Even though these innovations may be suitable for the specific individual purposes to which they address, they each differ in structure, and/or operation, and/or purpose, from the embodiments of the present invention in that they do not teach a tote bag for being partitioned or alternatively expanded.

(1) U.S. Pat. No. 920,852 to Flanagan.

U.S. Pat. No. 920,852 issued to Flanagan on May 4, 1909 teaches a hand bag, including a frame, a bag material secured to the frame and adapted to be folded upon itself. The bag material has end wings to fold inwardly when the bag is folded and to fold downwardly to provide supplemental folds to rest upon the bottom of the bag when the latter is extended. Spaced distending strips upon the bottom of the bag are adapted to fold together. Co-acting fastening devices on the supplemental folds or wings are adjacent the ends of the bag bottom to retain the distending strips in an open position and provide a flat bottom for the bag when extended. A flap receives the fold of the bag beneath it and thereby conceal the fold and co-acting fastening devices on the flap and folded portion of the bag material to retain the bag in a folded position.

(2) U.S. Pat. No. 1,143,171 to Bushwick.

U.S. Pat. No. 1,143,171 issued to Bushwick on Jun. 15, 1915 teaches a folding and extensible handbag, including a bottom member, side members, and intermediate members disposed between and flexibly connected with the side and bottom members. Foldable end members connect the side members. Apparatus detachably connects the end and bottom members.

(3) U.S. Pat. No. 2,018,809 to Rodgers.

U.S. Pat. No. 2,018,809 issued to Rodgers on Oct. 29, 1935 in class 190 and subclass 43 teaches a convertible bag, including a foldable bottom, opposed sidewalls, and apparatus for fastening the bottom in an infolded position between the walls. The bag has a flexible infolded top portion formed with a mouth and fastening apparatus for closing the mouth in the top portion. The bag has opposite foldable end portions held distended from the side walls and bottom by way of the infolded bottom and top portions of the bag.

(4) U.S. Pat. No. 4,078,595 to Mittelmann.

U.S. Pat. No. 4,078,595 issued to Mittelmann on Mar. 14, 1978 in class 150 and subclass 30 teaches a carrying case serving as a handbag having a compartment for retaining normal handbag materials and including a second compartment being expanded and can be used as a shopping bag. A movable dividing wall serves to selectively close off each compartment so that a common access of the carrying case is utilized for each of the two compartments.

(5) U.S. Pat. No. Des. 377,415 to Jacobs et al.

U.S. Pat. No. Des. 377,415 issued to Jacobs et al. on Jan. 21, 1997 in class D3 and subclass 206 teaches the ornamental design for an expandable school bag with a front utility compartment.

(6) U.S. Pat. No. 6,568,852 to Godshaw et al.

U.S. Pat. No. 6,568,852 issued to Godshaw et al. on May 27, 2003 in class 383 and subclass 2 teaches an expandable carrier or pouch, including a front and a back panel connected by a double tab zipper, with an expandable gusset joined between the panels.

(7) United States Patent Application Publication No. 2006/0090823 to Repke et al.

United States Patent Application Publication No. 2006/0090823 published to Repke et al on May 4, 2006 in class 150 and subclass 113 teaches a travel bag for organizing a computer and other items, having a computer compartment including pockets for small items and a dual-entry pocket. Flat pockets are provided on two large sides of the dual-entry pocket. An opening on the outer body of the bag provides access to contents of the dual-entry pocket and flat pockets. The flat pockets are made of elastic material for securely holding small items and devices that are frequently retrieved, such as a cell phone, travel tickets, sunglasses, etc. A briefcase style includes a retractable flap covering the top of the bag and slides down into the bag to provide unfettered access to contents. A tote style has deep pockets in expandable side gussets for holding a water bottle, an umbrella, shoes, etc. Straps are rope-filled tubular leather. A cord kit, a tool kit, and a purse may be included.

(8) United States Patent Application Publication No. 2006/0090976 to Repke et al.

United States Patent Application Publication No. 2006/0090976 published to Repke et al. on May 4, 2006 in class 190 and subclass 110 teaches a travel bag for organizing computer and other items, having a computer compartment including pockets for small items and a dual-entry pocket. Flat pockets are provided on two large sides of the dual-entry pocket. An opening on the outer body of the bag provides access to contents of the dual-entry pocket and flat pockets. The flat pockets are made of elastic material for securely holding small items and devices that are frequently retrieved, such as a cell phone, travel tickets, sunglasses, etc. A briefcase style includes a retractable flap covering the top of the bag and slides down into the bag to provide unfettered access to contents. A tote style has deep pockets in expandable side gussets for holding a water bottle, an umbrella, shoes, etc. Straps are rope-filled tubular leather. A cord kit, a tool kit, and a purse may be included.

(9) United States Patent Application Publication No. 2006/0215938 to Yu.

United States Patent Application Publication No. 2006/0215938 published to Yu on Sep. 28, 2006 in class 383 and subclass 2 teaches an apparatus capable of collapsing into a smaller configuration. The apparatus includes a first sidewall and a second sidewall interconnected by a bottom wall, a front wall, a rear wall, and a top wall to form a collapsible bag. A first zipper track is disposed into the bottom wall connecting between a portion of the bottom wall and a first position. A second zipper track is disposed into the bottom wall opposite to the first zipper track. The second zipper track is located between the portion of the bottom wall and a second position. A zipper slider is provided for connecting together the first zipper track and the second zipper track for coupling of the first zipper track and the second zipper track along the contour of the collapsible bag.

It is apparent that numerous innovations for bags have been provided in the prior art that are adapted to be used. Furthermore, even though these innovations may be suitable for the specific individual purposes to which they address, they would not be suitable for the purposes of the embodiments of the present invention as heretofore described, namely, a tote bag for being partitioned or alternatively expanded.

SUMMARY OF THE INVENTION

Thus, an object of the embodiments of the present invention is to provide a tote bag for being partitioned or alternatively expanded, which avoids the disadvantages of the prior art.

Briefly stated, another object of the embodiments of the present invention is to provide a tote bag for being partitioned or alternatively expanded. The bag has a partition mode and an expansion mode and includes a front panel, a rear panel, and a pair of side panels. The front panel is attached to the rear panel by the pair of side panels. The pair of side panels fold and attach to each other to form a partition thereby dividing the tote bag into a pair of compartments when the tote bag is in the partition mode thereof and separate from each other and unfold to eliminate the partition thereby expanding the tote bag when the tote bag is in the expansion mode thereof.

The novel features are considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
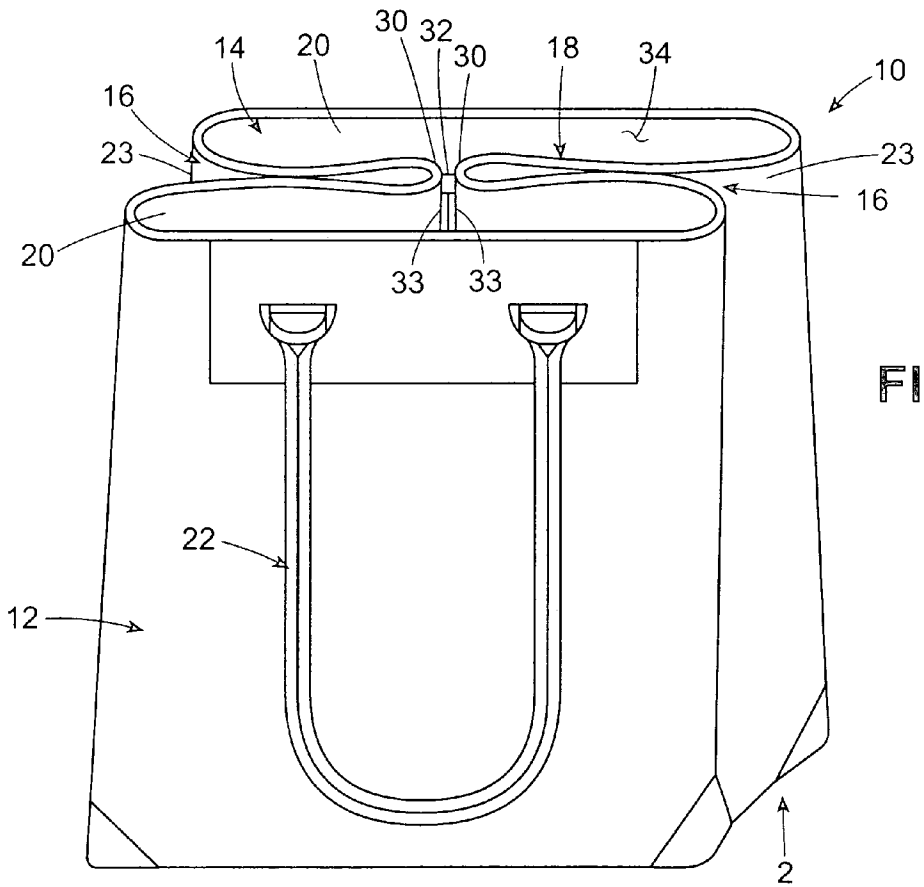
FIG. 1 is a diagrammatic perspective view of the tote bag of the embodiments of the present invention partitioned.

A. General.

10 tote bag of embodiments of present invention for being partitioned or alternatively expanded B. Configuration.

12 front panel
14 rear panel
16 pair of side panels
18 partition
20 pair of compartments
22 pair of straps
23 expandable side gusset of each side panel of pair of side panels 16
24 upper area of each side panel of pair of side panels 16
26 outer surface of upper area 24 of each side panel of pair of side panels 16
28 snap fastener
30 inner bend of each side panel of pair of side panels 16
32 zipper
33 pair of zipper tracks of zipper 32
34 inner surface of rear panel 14
36 pockets
38 expandable pocket of pockets 36
40 bottom panel
42 zipper
44 pair of zipper tracks of zipper 42

DETAILED DESCRIPTION OF THE PREFERRED EMBODIMENTS

A. General.

Figure 2:
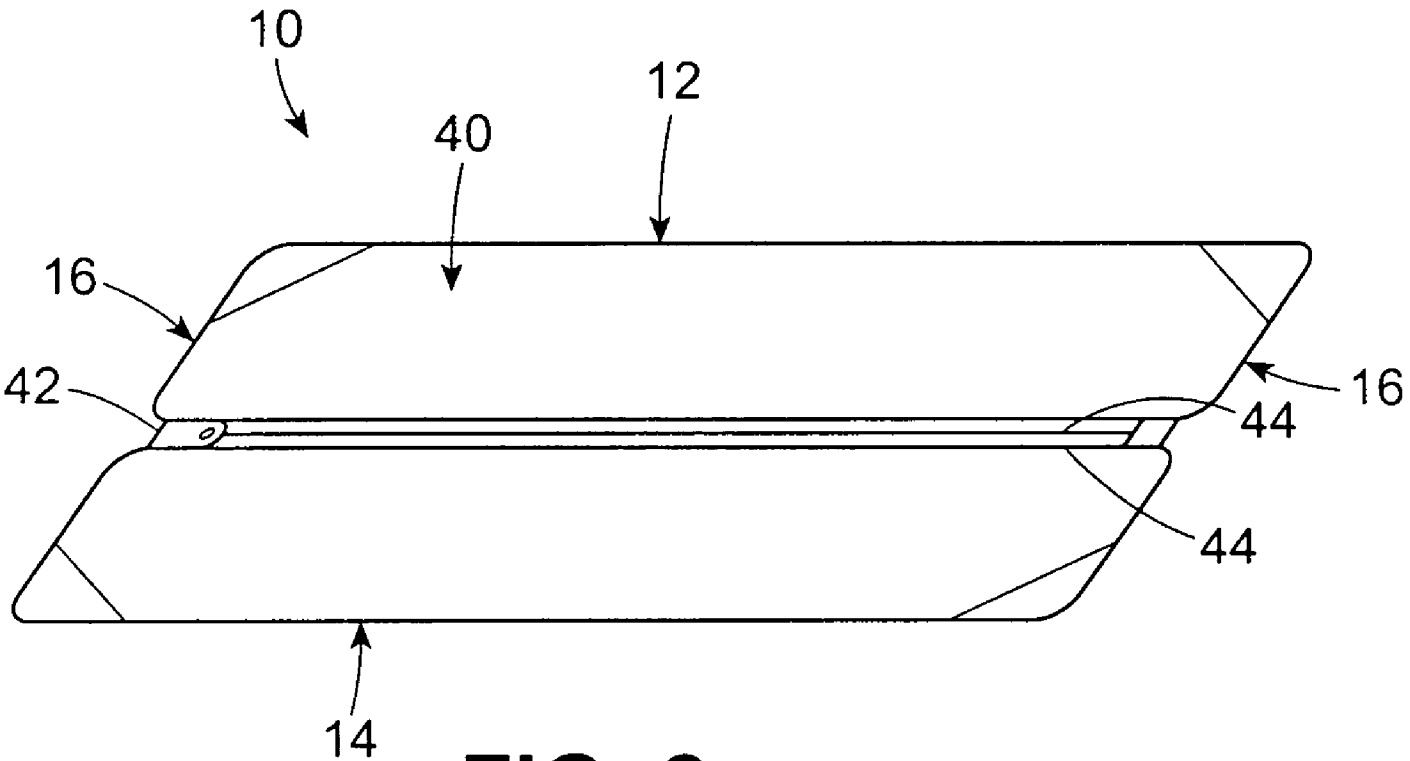
FIG. 2 is a diagrammatic bottom plan view taken generally in the direction of ARROW 2 in FIG. 1.
Figure 3:
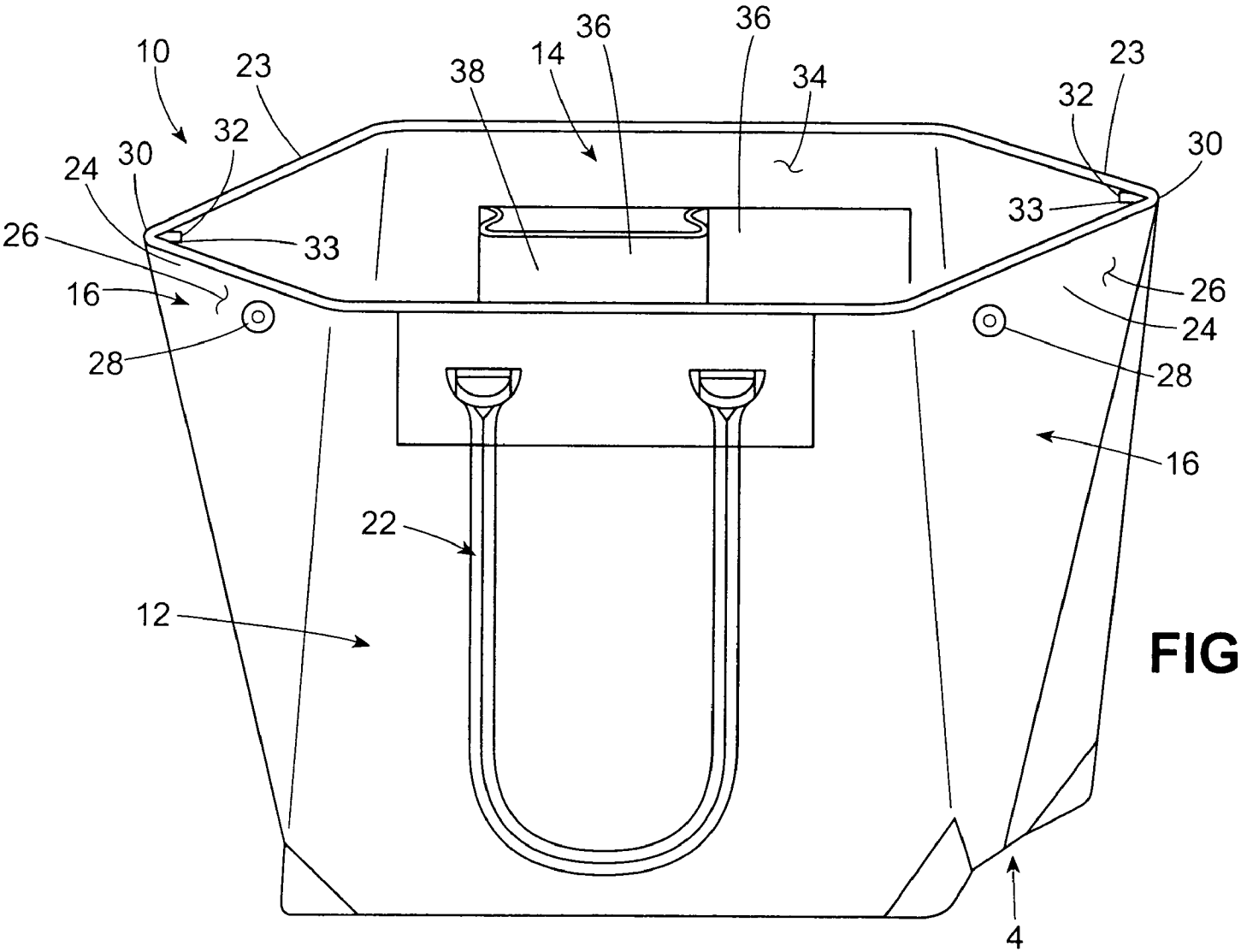
FIG. 3 is a diagrammatic perspective view of the tote bag of the embodiments of the present invention expanded.

Referring now to the figures, in which like numerals indicate like parts, and particularly to FIGS. 1 and 3, which are, respectively, a diagrammatic perspective view of the tote bag of the embodiments of the present invention partitioned, and a diagrammatic perspective view of the tote bag of the embodiments of the present invention expanded, the tote bag of the embodiments of the present invention is shown generally at 10 for being partitioned (FIG. 1) or alternatively expanded (FIG. 2).

B. The Configuration.

The tote bag 10 has a partition mode and an expansion mode and comprises a front panel 12, a rear panel 14, and a pair of side panels 16. The front panel 12 is attached to the rear panel 14 by the pair of side panels 16. The pair of side panels 16 fold and attach to each other to form a partition 18 thereby dividing the tote bag 10 into a pair of compartments 20 when the tote bag 10 is in the partition mode thereof (FIG. 1) and separate from each other and unfold to eliminate the partition 18 thereby expanding the tote bag 10 when the tote bag 10 is in the expansion mode thereof (FIG. 2).

The tote bag 10 further comprises a pair of straps 22. The pair of straps 22 are tubular and pivotally attached to the front panel 12 and to the rear panel 14, respectively, so as to fold thereupon when not in use and extend from thereupon when in use.

Each side panel 16 folds unto itself to form an expandable side gusset 23 and replaceably attaches to each other to form the partition 18 thereby dividing the tote bag 10 into the pair of compartments 20 when the tote bag 10 is in the partition mode thereof (FIG. 1) and separates from each other and unfolds from itself to eliminate the partition 18 thereby expanding the tote bag 10 when the tote bag 10 is in the expansion mode thereof (FIG. 2).

Each side panel 16 has an upper area 24 with an outer surface 26, and is replaceably maintained folded unto itself by a snap fastener 28. The snap fastener 28 is disposed on the outer surface 26 of the upper area 24 of each side panel 16.

Each side panel 16 has an inner bend 30. The inner bend 30 of each side panel 16 faces each other when the tote bag 10 is in the partition mode thereof. Each side panel 16 folds unto itself and replaceably attaches to each other to form the partition 18 when the tote bag 10 is in the partition mode thereof by a zipper 32. The zipper 32 has a pair of zipper tracks 33 extending along the inner bend 30 of each side panel 16, respectively.

The rear panel 14 has an inner surface 34. The inner surface 34 of the rear panel 14 has pockets 36 thereon. One pocket 36 is an expandable pocket 38.

Figure 4:
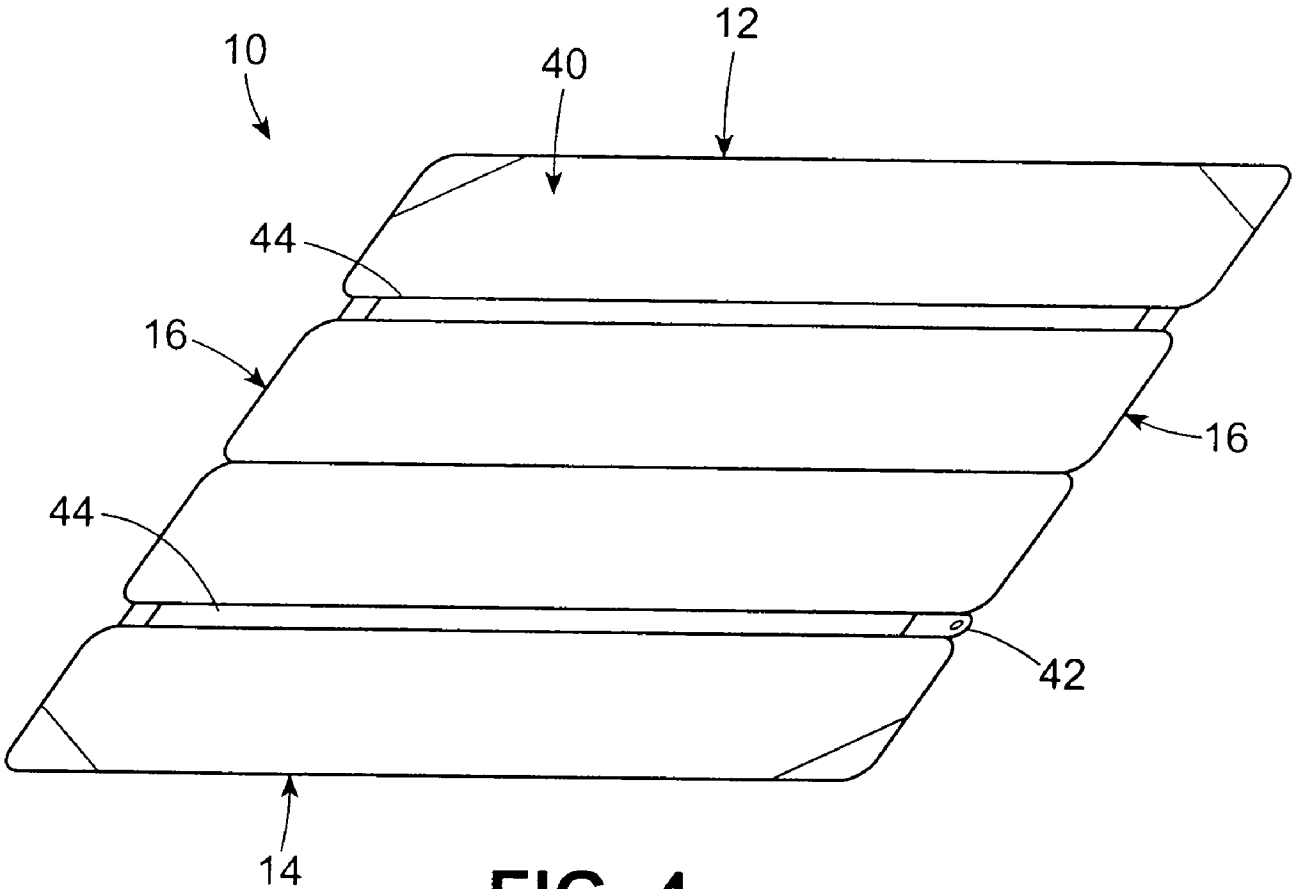
FIG. 4 is a diagrammatic bottom plan view taken generally in the direction of ARROW 4 in FIG. 1.

As shown in FIGS. 2 and 4, which is a diagrammatic bottom plan view taken generally in the direction of ARROW 2 in FIG. 1, and a diagrammatic bottom plan view taken generally in the direction of ARROW 4 in FIG. 1, the tote bag 10 further has a bottom panel 40. The bottom panel 40 is attached to the front panel 12, the rear panel 14, and the pair of side panels 16.

The bottom panel 40 folds and attaches to itself when the tote bag 10 is in the partition mode thereof (FIG. 2) and separates from itself and unfolds when the tote bag 10 is in the expansion mode thereof (FIG. 4).

The bottom panel 40 folds unto itself and replaceably attaches to itself when the tote bag 10 is in the partition mode thereof by a zipper 42. The zipper 42 has a pair of zipper tracks 44 extending along the bottom panel 40.

C. The Conclusions.

It will be understood that each of the elements described above or two or more together may also find a useful application in other types of constructions differing from the types described above.

While the embodiments of the present invention have been illustrated and described as embodied in a tote bag for being partitioned or alternatively expanded, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt it for various applications without omitting features that from the standpoint of prior art fairly constitute characteristics of the generic or specific aspects of the embodiments of the present invention.

The invention claimed is:

1. A tote bag for being partitioned or alternatively expanded, wherein said tote bag has a partition mode and an expansion mode, said tote bag comprising:

a) a front panel;

b) a rear panel;

c) a pair of side panels; and d) a bottom panel;

wherein said front panel is attached to said rear panel by said pair of side panels;

wherein said pair of side panels fold and attach to each other to form a partition thereby dividing said tote bag into a pair of compartments when said tote bag is in said partition mode thereof and separate from each other and unfold to eliminate said partition thereby expanding said tote bag when said tote bag is in said expansion mode thereof;

wherein said bottom panel is attached to said front panel;

wherein said bottom panel is attached to said rear panel;

wherein said bottom panel is attached to said pair of side panels;

wherein each side panel is replaceably maintained folded unto itself by a snap fastener;

wherein each side panel has an upper area;

wherein said upper area of each side panel has an outer surface;

wherein said snap fastener is disposed on said outer surface of said upper area of each side panel;

wherein each side panel folds unto itself and replaceably attaches to each other to form said partition when said tote bag is in said partition mode thereof by a zipper;

wherein said zipper has a pair of zipper tracks;

wherein each side panel has an inner bend;

wherein said inner bend of each side panel faces each other when said tote bag is in said partition mode thereof;

wherein said pair of zipper tracks of said zipper extend along said inner bend of each side panel, respectively;

wherein said bottom panel folds unto itself and replaceably attaches to itself when said tote bag is in said partition mode thereof by a zipper;

wherein said zipper has a pair of zipper tracks extending along said bottom panel;

wherein said pair of zipper tracks of said zipper are spaced within said bottom panel; and wherein said pair of zipper tracks of said zipper are attached and visible when said tote bag is in said partition mode thereof and separate when said tote bag is in said expansion mode thereof.

2. The tote bag of claim 1, further comprising a pair of straps; and wherein said pair of straps are pivotally attached to said front panel and to said rear panel, respectively, so as to fold thereupon when not in use and extend from thereupon when in use.

3. The tote bag of claim 1, wherein each side panel folds unto itself to form an expandable side gusset and replaceably attaches to each other to form said partition thereby dividing said tote bag into said pair of compartments when said tote bag is in said partition mode thereof and separates from each other and unfolds from itself to eliminate said partition thereby expanding said tote bag when said tote bag is in said expansion mode thereof.

4. The tote bag of claim 1, wherein said rear panel has an inner surface; and wherein said inner surface of said rear panel has pockets thereon.

5. The tote bag of claim 4, wherein one pocket is an expandable pocket.

* * * * *